US007302921B2

(12) United States Patent
McDonald et al.

(10) Patent No.: US 7,302,921 B2
(45) Date of Patent: Dec. 4, 2007

(54) DETECTION OF A SPECIFIC FAULTED DOD ELECTROHYDRAULIC CIRCUIT

(75) Inventors: Mike M. McDonald, Macomb, MI (US); William C. Albertson, Clinton Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 305 days.

(21) Appl. No.: 11/195,856

(22) Filed: Aug. 2, 2005

(65) Prior Publication Data

US 2007/0028877 A1 Feb. 8, 2007

(51) Int. Cl.
*F01L 9/02* (2006.01)

(52) U.S. Cl. ..... 123/90.12; 123/90.15

(58) Field of Classification Search ..... 123/90.12, 123/90.13, 90.15, 90.16, 90.17, 345, 346, 123/347, 348

See application file for complete search history.

(56) References Cited

U.S. PATENT DOCUMENTS 7,086,374 B2 * 8/2006 McDonald et al. ..... 123/198 F
2002/0189575 A1 12/2002 Rayl et al.

* cited by examiner

*Primary Examiner*—Ching Chang

(57) ABSTRACT

A fault detection system for detecting a fault in a lifter oil manifold assembly (LOMA) of a displacement on demand engine that is operable during transition from activated and deactivated modes includes a first fluid circuit of the LOMA that selectively provides pressurized fluid to regulate operation of the engine between activated and deactivated modes. The fault detection system further includes a sensor that is responsive to fluid pressure of the LOMA and that generates a pressure signal based thereon. A control module outputs a control signal to switch operation of the engine between the activated and deactivated modes. The control module further determines a pressure differential based on a first pressure prior to switching between the modes and a second pressure after switching between the modes.

22 Claims, 6 Drawing Sheets

DETECTION OF A SPECIFIC FAULTED DOD ELECTROHYDRAULIC CIRCUIT

FIELD OF THE INVENTION

The present invention relates to internal combustion engines, and more particularly to engine control systems for displacement on demand engines.

BACKGROUND OF THE INVENTION

Some internal combustion engines include engine control systems that deactivate cylinders under low load situations. For example, an eight cylinder engine can be operated using four cylinders to improve fuel economy by reducing pumping losses. This process is generally referred to as displacement on demand (DOD). Operation using all of the engine cylinders is referred to as an activated mode. A deactivated mode refers to operation using less than all of the cylinders of the engine (i.e., one or more cylinders not active).

In the deactivated mode, there are fewer cylinders operating. As a result, there is less drive torque available to drive the vehicle driveline and accessories (e.g., alternator, coolant pump, A/C compressor). Engine efficiency, however, is increased as a result of decreased fuel consumption (i.e., no fuel supplied to the deactivated cylinders). Because the deactivated cylinders do not compress fresh air, pumping losses are also reduced.

A lifter oil manifold assembly (LOMA) is implemented to activate and deactivate select cylinders of the engine. The LOMA includes lifters and solenoids associated with corresponding cylinders. The solenoids are selectively energized to enable hydraulic fluid flow to the lifters to disable cylinder operation, thereby deactivating the corresponding cylinders. It is possible that one or more of the solenoids could seize or become slow to actuate and cause the system to operate improperly. As a result, the LOMA may need to be replaced.

SUMMARY OF THE INVENTION

Accordingly, a fault detection system for detecting a fault in a lifter oil manifold assembly (LOMA) of a displacement on demand engine that is operable in activated and deactivated modes includes a first fluid circuit of the LOMA that selectively provides pressurized fluid to regulate operation of the engine between activated and deactivated modes. The fault detection system further includes a sensor that is responsive to fluid pressure of the LOMA and that generates a pressure signal based thereon. A control module outputs a control signal to switch operation of the engine between the activated and deactivated modes. The control module further determines a pressure differential based on a first pressure prior to switching between the modes and a second pressure after switching between the modes.

In one feature, the control module determines a PASS/FAIL status event of the first fluid circuit based on the pressure differential and a predetermined pressure differential range.

In another feature, the pressure differential range is defined by an upper pressure differential value and a lower pressure differential value.

In another feature, the control module indicates a FAIL status event of the first fluid circuit when the pressure differential is lower than the lower pressure differential value.

In still another feature, the control module indicates a FAIL status event of the first fluid circuit when the pressure differential is greater than the upper pressure differential value.

In yet other features, the first fluid circuit includes a solenoid that selectively enables a flow of pressurized fluid to a lifter associated with a cylinder of the engine. The control module calculates the pressure differential based on a first pressure prior to the solenoid enabling the flow of pressurized fluid pressure and a second pressure subsequent to the solenoid enabling the flow of pressurized fluid.

In still another feature, the control module detects a faulty fluid circuit when the number of FAIL status events exceeds a predetermined FAIL status range.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
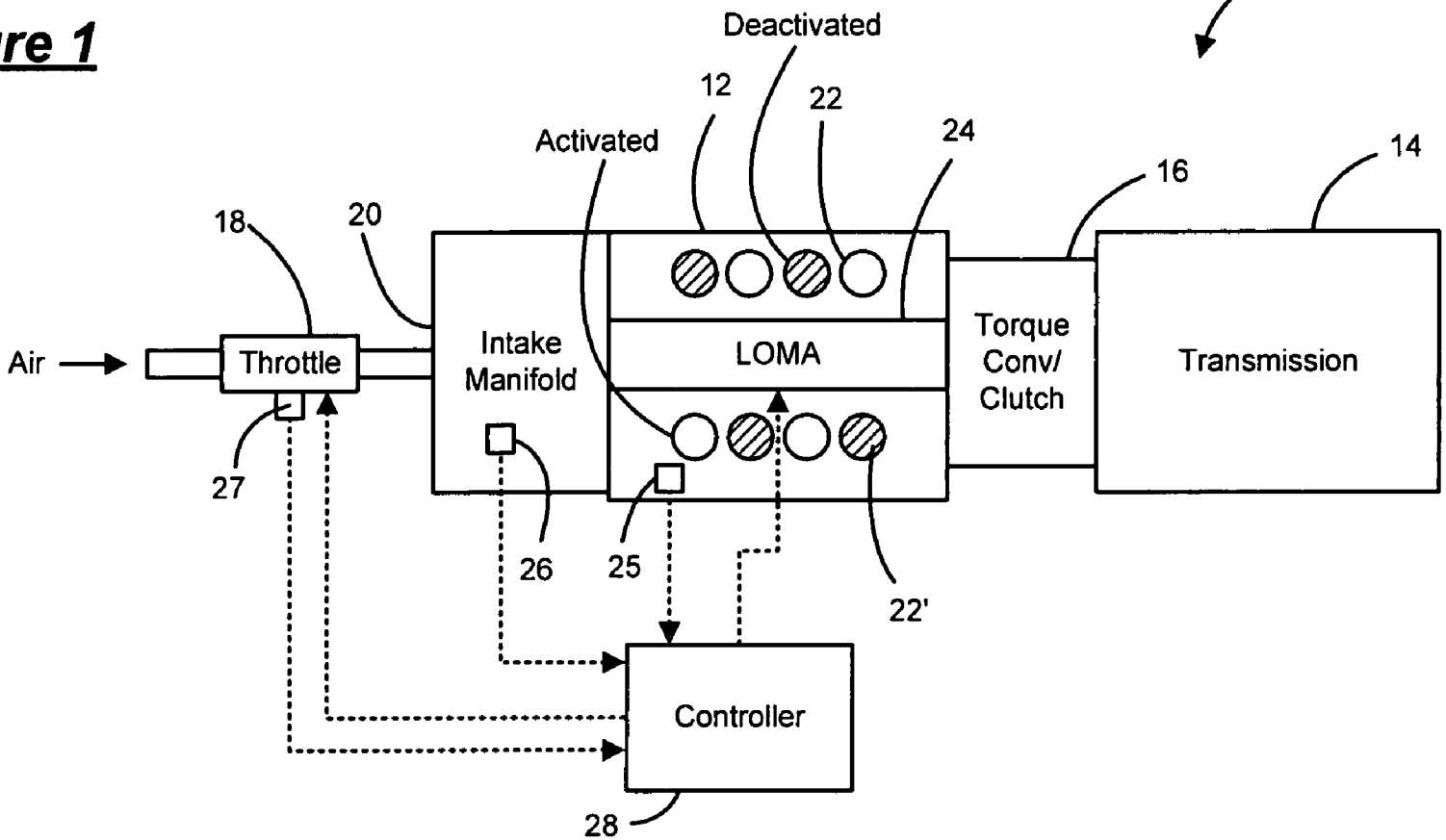
FIG. 1 is a functional block diagram illustrating a vehicle powertrain including a displacement on demand (DOD) engine control system according to the present invention.

The following description of the preferred embodiment is merely exemplary in nature and is in no way intended to limit the invention, its application, or uses. For purposes of clarity, the same reference numbers will be used in the drawings to identify similar elements. As used herein, activated refers to operation using all of the engine cylinders. Deactivated refers to operation using less than all of the cylinders of the engine (one or more cylinders not active). As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an engine system 10 includes an engine 12 and a transmission 14. The transmission 14 can be an automatic or a manual transmission that is driven by the engine through a corresponding torque converter or clutch 16.

A throttle 18 that regulates air flow into an intake manifold 20. The intake manifold 20 delivers air into cylinders 22 where it is mixed with fuel and is combusted to drive pistons (not shown). One or more cylinders 22' may be selectively deactivated during engine operation. Although FIG. 1 depicts 8 cylinders, it can be appreciated that the engine 12 may include additional or fewer cylinders. For example, engines having 4, 5, 6, 8, 10, 12 and 16 cylinders are contemplated. A lifter oil manifold assembly (LOMA) 24 is implemented in the engine 12 and deactivates select cylinders 22', as discussed further below. Furthermore, the engine system 10 includes an engine speed sensor 25, an intake manifold absolute pressure (MAP) sensor 26 and a throttle position sensor (TPS) 27. The engine speed sensor 25 generates a signal indicative of engine speed. The MAP sensor generates a signal indicating a pressure of the intake manifold 20. The TPS 27 generates a signal indicative of a position of the throttle 18. A control module 28 communicates with the engine 12 and the various sensors and actuators to selectively deactivate cylinders 22', as discussed below.

A vehicle operator manipulates an accelerator pedal (not shown) to regulate the throttle 18. The control module 28 outputs a throttle control signal based on the position of the accelerator pedal. A throttle actuator (not shown) adjusts the throttle 18 based on the throttle control signal to regulate air flow into the engine 12

When predetermined conditions occur, the control module 28 can operate the engine 12 in the deactivated mode. In an exemplary embodiment, N/2 cylinders 22' are deactivated, although one or more cylinders 22' may be deactivated. When the selected cylinders 22' are deactivated, the control module 28 increases the power output of the activated cylinders 22. The inlet and exhaust ports (not shown) of the deactivated cylinders 22' are closed to reduce fuel consumption and pumping losses.

The engine load can be determined based on the intake MAP, cylinder mode and engine speed. More particularly, if the MAP is below a predetermined threshold value for a given RPM, the engine load is deemed light and the engine 12 can possibly be operated in the deactivated mode. If the MAP is above the threshold value for the given RPM, the engine load is deemed heavy and the engine 12 is operated in the activated mode.

Figure 2:
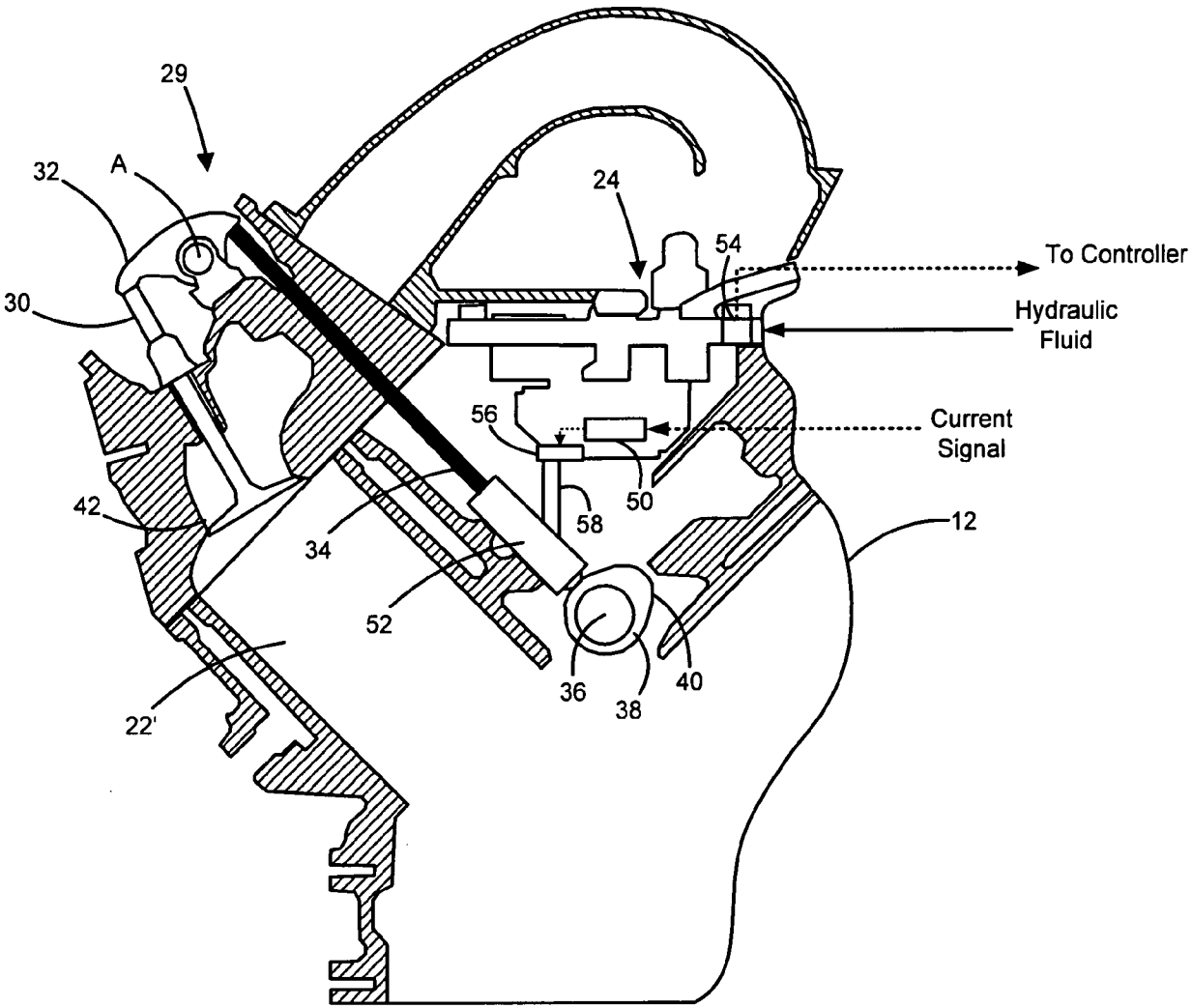
FIG. 2 is a partial cross-sectional view of the DOD engine including a lifter oil manifold assembly (LOMA) and an intake valvetrain.

Referring now to FIG. 2, an intake valvetrain 29 of the engine 12 includes an intake valve 30, a rocker 32 and a pushrod 34 associated with each cylinder 22'. The engine 12 includes a rotatably driven camshaft 36 having a plurality of valve cams 38 disposed therealong. A cam surface 40 of the cams 38 engage the pushrods 34 to cyclically open and close intake ports 42 within which the intake valves 30 are positioned. The intake valve 30 is biased to a closed position by a biasing member (not illustrated) such as a spring. As a result, the biasing force is transferred through the rocker 32 to the pushrod 34 causing the pushrod 34 to press against the cam surface 40.

As the camshaft 36 rotates, the cam 38 induces linear motion of the corresponding pushrod 34. As the pushrod moves outward, the rocker 32 is caused to pivot about an axis (A). Pivoting of the rocker 32 induces movement of the intake valve 30 toward an open position, thereby opening the intake port 42. The biasing force induces the intake valve 30 to a closed position as the camshaft 36 continues to rotate. In this manner, the intake port 42 is cyclically opened to enable air intake.

Although the intake valvetrain 29 of the engine 12 is illustrated in FIG. 2, it can be appreciated that the engine 12 also includes an exhaust valvetrain (not shown) that operates in a similar manner. More specifically, the exhaust valvetrain includes an exhaust valve, a rocker and a pushrod associated with each cylinder 22'. Rotation of the camshaft 36 induces reciprocal motion of the exhaust valves to open and close associated exhaust ports, as similarly described above for the intake valvetrain 29.

The LOMA 24 directs a supply of hydraulic fluid to a plurality of fluid circuits. Typically, a single fluid circuit is associated with each set of cylinder valves. A single fluid circuit includes a solenoid 50 and at least one lifter 52. The solenoid 50 regulates the pressure of hydraulic fluid to the lifter 52 associated with select cylinders 22', as discussed further below. The selected cylinders 22' are those that are deactivated when operating the engine 12 in the deactivated mode. The lifters 52 are disposed within the intake and exhaust valvetrains to provide an interface between the cams 38 and the pushrods 34. Typically, there are two lifters 52 provided for each select cylinder 22' (one lifter 52 for the intake valve 30 and one lifter for the exhaust valve). It can be appreciated, however, that additional lifters 52 can be associated with each select cylinder 22' (i.e., multiple inlet or exhaust valves per cylinder 22'). The LOMA 24 further includes one or more pressure sensors 54 that communicate with the control module 28 and that generate a pressure signal indicating a pressure of the hydraulic fluid to the LOMA 24.

Figure 3:
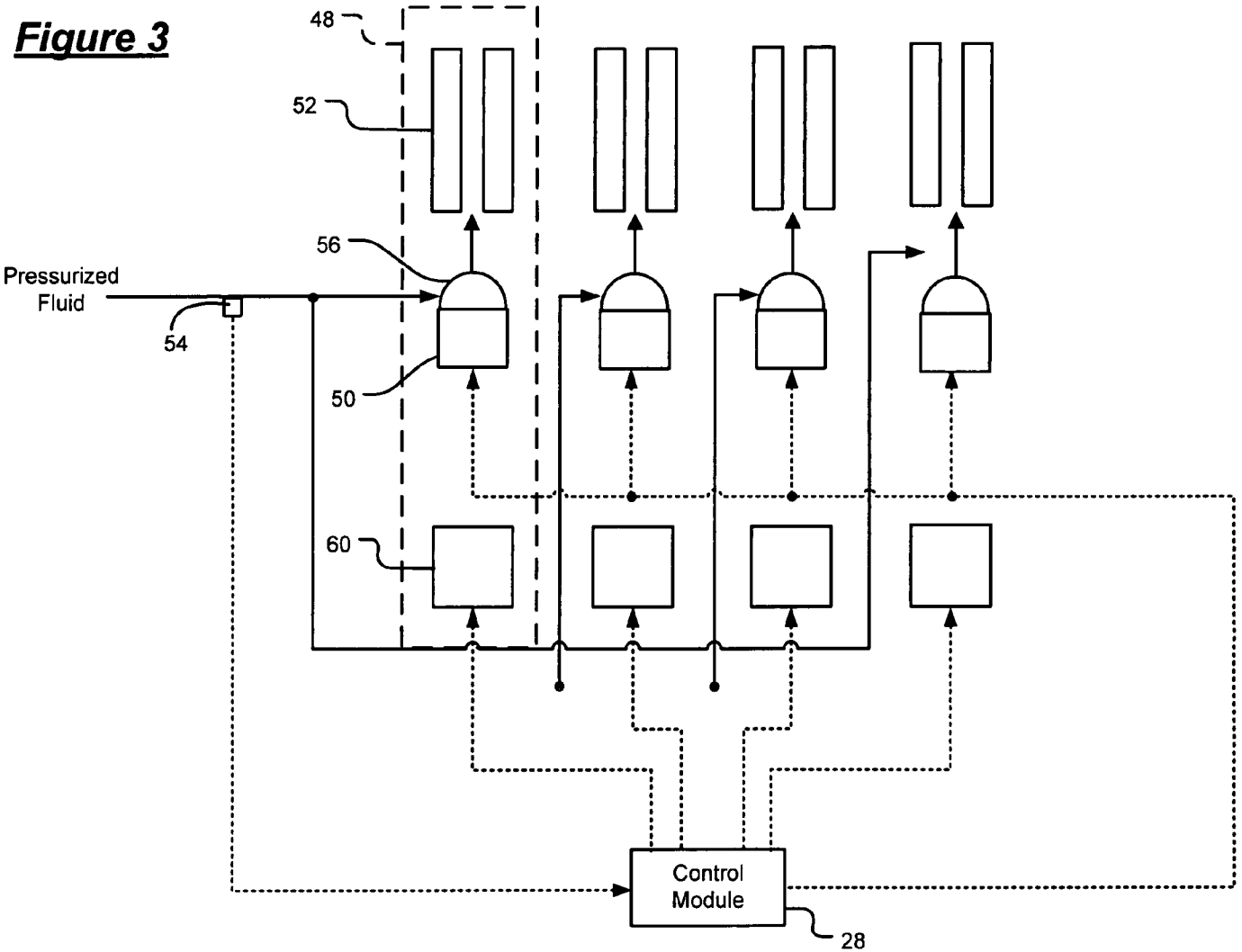
FIG. 3 is partial plan view illustrating a LOMA.

Referring now to FIG. 3, the LOMA 24 is schematically illustrated. A single fluid circuit 48 includes a solenoid 50, a pair of lifters 52 and a valve 56. The fluid circuit 48 further includes a counter 60 that communicates with the control module and is incremented when the fluid circuit 48 experiences a fault, as discussed further below.

The solenoid 50 communicates with the control module 28 and selectively actuates the valve 56 coupled thereto between open and closed positions. Although one solenoid 50 is shown with each select cylinder 22' (i.e., one solenoid for two lifters), additional or fewer solenoids 50 can be implemented. The position of the valve 56 regulates the flow of hydraulic fluid delivered to the lifter 52. In the closed position, the valve 56 inhibits pressurized hydraulic fluid flow to the corresponding lifter 52. In the open position, the valve 56 delivers pressurized fluid flow to the corresponding lifter 52 through a fluid passage (not shown). The lifter 52 is hydraulically actuated between first and second modes based on a supply of hydraulic fluid. The first and second modes respectively correspond to the activated and deactivated modes of the engine 12, respectively.

Although not illustrated, a brief description of an exemplary solenoid 50 is provided herein to provide a better understanding of the present invention. The solenoids 50 typically include an electromagnetic coil, a plunger and a mechanical interface, such as the valve 56. The plunger (not shown) is disposed coaxially within the coil and provides a mechanical interface between the solenoid 50 and the valve 56. The plunger is biased to a first position relative to the coil by a biasing force. The biasing force can be imparted by a biasing member, such as a spring, or by a pressurized fluid. The solenoid 50 is energized by supplying electrical current to the coil, which induces a magnetic force along the coil axis. The magnetic force induces linear movement of the plunger to a second position. In the first position, the plunger holds the valve in its closed position to inhibit pressurized hydraulic fluid flow to the corresponding lifters. In the second position, the plunger actuates the valve 56 to its open position to enable pressurized hydraulic fluid flow to the corresponding lifters.

When the control module 28 initiates the deactivated mode of engine 12 operation, hydraulic fluid flows throughout the LOMA 24 and is directed to each of the corresponding lifters 52.

The control module 28 includes a diagnostic system that determines the operation of the LOMA 24 based on the fluid pressure and faults associated with corresponding fluid circuits. The control module 28 receives a pressure signal and determines a PASS/FAIL status of a fluid circuit 48 based on a pressure differential and a predetermined pressure differential range. More specifically, a first pressure value ($P_{PRE}$) is stored prior to energizing a specific solenoid 50 corresponding to a specific fluid circuit 48 ($C_N$). The control module 28 will select the first solenoid to be energized based upon the instantaneous position of the engine at the time it makes the decision to transition the engine to the deactivated mode. Since the instantaneous position of the engine at the transition time can be thought of as a random function, the first solenoid to get energized can be considered a random function. The random selection ensures that each fluid circuit 48 is evaluated during a driving scenario. Subsequent to energizing the first solenoid 50, the control module 28 determines the time when the fluid pressure of the LOMA 24 will decrease due to opening the solenoid valve 56. The control module 28 retrieves a programmed time parameter ($t_{DEAC_SOL_RESPONSE}$) and calculates a time when the fluid pressure will be at a minimum ($t_{MIN}$). At $t_{MIN}$, the control module 28 stores a second pressure value ($P_{POST}$). The parameter $t_{DEAC_SOL_RESPONSE}$ is discussed in greater detail in commonly assigned US Published Patent Application No. 20020189575, which is hereby incorporated by reference in its entirety.

The control module 28 further determines a pressure differential ($\Delta P$) based on $P_{PRE}$ and $P_{POST}$ and compares the result to a predetermined pressure differential range ($P_{RANGE}$). $P_{RANGE}$ is defined as having a predetermined upper pressure value ($P_H$) and a predetermined lower pressure value ($P_L$). When $\Delta P$ exceeds $P_H$, or when $\Delta P$ is less than $P_L$, the control module 28 indicates a FAIL status event by incrementing the counter 60 associated with the corresponding fluid circuit 48. Although the counters 60 are shown externally, the counters 60 may be implemented within the control module 28.

Figures 4A, 4B:
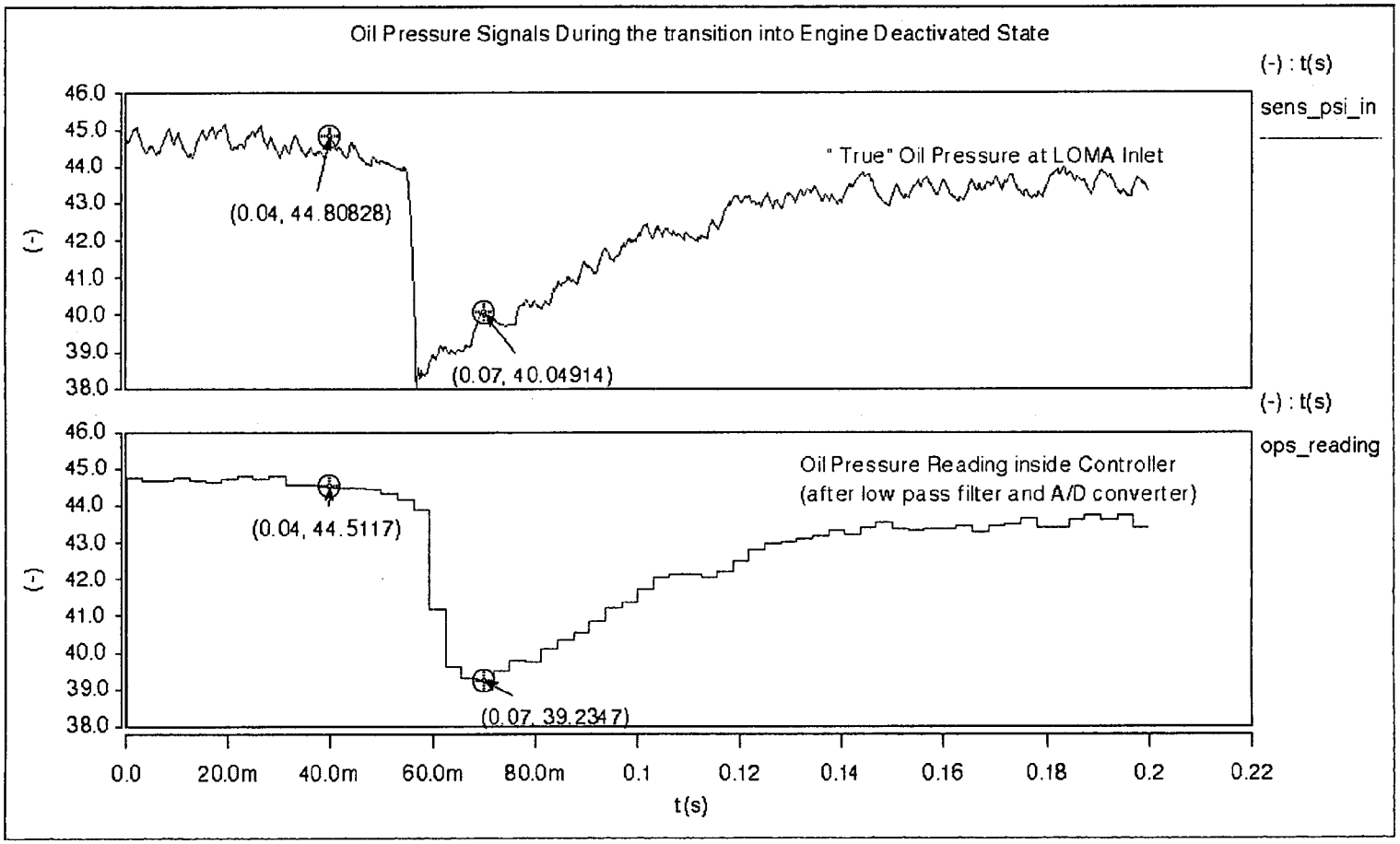
FIGS. 4A and 4B are graphs illustrating the oil pressure of the LOMA sampled over a period of time before and after operating the engine in activated and deactivated modes, according to the present invention.

Referring now to FIGS. 4A and 4B, exemplary graphs illustrating the oil pressure of the LOMA 24 sampled over a period of time before and after operating the engine 12 in activated and deactivated modes are shown. FIG. 4A shows an actual oil pressure signal appearing at the oil pressure sensor 54 when the fist electrohydraulic circuit 48 is energized. The oil pressure sensor 54 measures the oil pressure of the LOMA 24 and outputs an analogue signal to the control module 28. The analogue oil pressure signal is filtered to remove noise prior to being converted to a digital signal. The digital oil pressure signal is further scaled and numerically converted into engineering units of measurement.

FIG. 4B shows the oil pressure signal after being filtered and digitally converted. Reading A could be taken at time=0.04 seconds. Reading B could be taken at time=0.07 sec. The drop in pressure is due to oil flow into the solenoid valve 56. The pressure differential between these readings could be calculated to make a fault/no fault decision. Only the first fluid circuit 48 that is energized is analyzed because later fluid circuits will have large amounts of hydraulic noise in the pressure signal which may cause inaccurate measurements.

Figure 5:
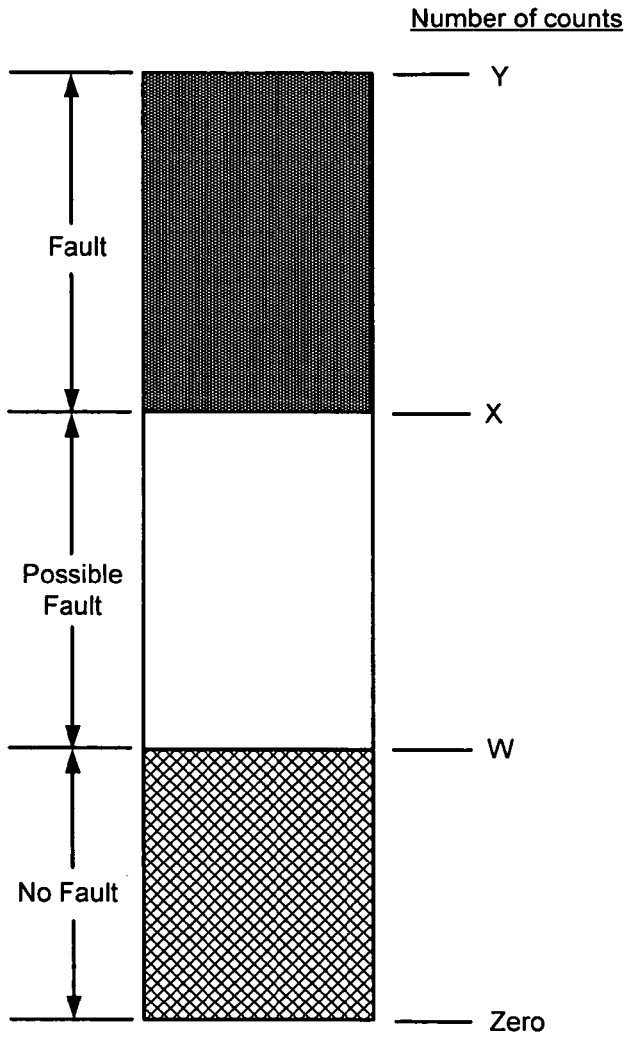
FIG. 5 is a graphical representation of an X out of Y counter according to the present invention.

Referring now to FIG. 5, a graphical representation of an X out of Y counter is illustrated. The counters 60 are characterized according to three predefined FAIL status event ranges. The first FAIL status event range ($RANGE_{FAULT}$) has an upper threshold equal to a first predetermined value and a lower threshold equal to a second predetermined threshold. The second FAIL status event range ($RANGE_{POS_FAULT}$) has an upper threshold equal to a third predetermined value and a lower threshold equal to a forth predetermined value. The third FAIL status event range ($RANGE_{NO_FAULT}$) has an upper threshold equal to a fifth predetermined value and a lower threshold equal to zero. Furthermore, the values defining $RANGE_{POS_FAULT}$ are greater then the values defining $RANGE_{NO_FAULT}$. The values defining $RANGE_{FAULT}$ are greater than the values defining $RANGE_{POS_FAULT}$ and $RANGE_{NO_FAULT}$.

A fluid circuit 48 is characterized as faulty when the number of fail status events recorded by the counter 60 exceeds $RANGE_{POS_FAULT}$. A fluid circuit 48 is characterized as having a possible fault when the number of fail status events corresponding to the fluid circuit equals a value that falls within $RANGE_{POS_FAULT}$. Finally, a fluid circuit 48 is characterized as having no fault when the number of fail status events corresponding to the fluid circuit 48 equals a value that falls within $RANGE_{NO_FAULT}$.

The control module 28 can further determine whether a specific fluid circuit ($C_N$) is faulty based on FAIL status events recorded by the counters 60 and the three predetermined FAIL status ranges. When $C_N$ is characterized as faulty, the remaining counters 60 are analyzed. If the number of fail status events recorded by the remaining counters 60 are within $RANGE_{NO_FAULT}$, and they are filled with readings, then the control module 28 determines that the fault is specific to $C_N$. The fault may include, but is not limited to, a seized solenoid 50 and/or a seized lifter pin. However, when a plurality of fluid circuits are characterized as faulty, then a problem exists that is not specific to a single fluid circuit 48. For example, a blocked fluid passage upstream from the fluid circuits may deliver an insufficient supply of hydraulic fluid that causes a low pressure differential signal.

Figure 6:
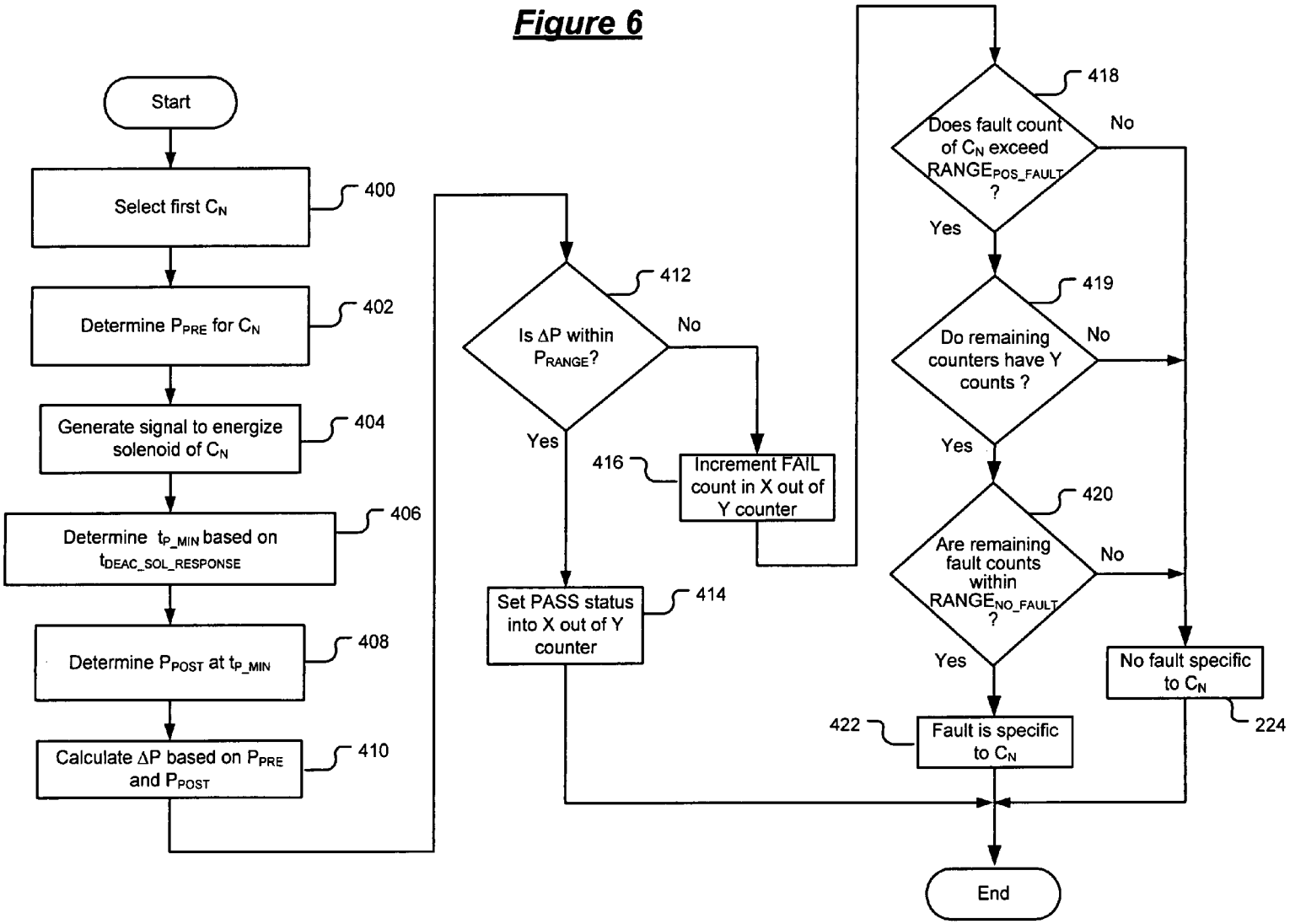
FIG. 6 is a flowchart illustrating steps of a method for detecting faults in a LOMA.

Referring now to FIG. 6, a flowchart illustrates the steps executed by the LOMA diagnostic control. In step 400, control randomly selects the solenoid 50 associated with $C_N$ to energize. In step 402, control determines $P_{PRE}$ prior to energizing the solenoid 50. Control energizes the solenoid 50 associated with $C_N$ in step 404. In step 406, control determines $t_{P_MIN}$ based on a predetermined time parameter ($t_{DEAC_SOL_RESPONSE}$). Control determines $P_{POST}$ at $t_{P_MIN}$ in step 408. In step 410, control calculates $\Delta P$ based on $P_{PRE}$ and $P_{POST}$.

In step 412, control determines whether $\Delta P$ is within $P_{RANGE}$. When $\Delta P$ is within $P_{RANGE}$, control sets a PASS status in step 414, delivers that PASS reading to the associated X out of Y counter and control ends. When $\Delta P$ is not within $P_{RANGE}$, control delivers a FAIL reading to the associated X out of Y counter 60 corresponding to $C_N$ in step 416, and proceeds to determine whether the fault is specific to $C_N$. In step 418, control determines whether the FAIL status event total associated with $C_N$ exceeds $RANGE_{POS_FAULT}$. When the FAIL status event total does not exceed $RANGE_{POS_FAULT}$, control determines that the fault is not specific to $C_N$ in step 424. Otherwise, control determines whether the remaining X out of Y counters are filled with readings in step 419, When the remaining X out of Y counters are not filled with readings, control proceeds to step 424 because it cannot be determined if the fault is specific to circuit $C_N$.

When, in step 419, control determines all of the other counters are filled with readings, control will proceed to check if the FAIL status event totals associated with the remaining fluid circuits are within $RANGE_{NO_FAULT}$ in step 420. If the remaining fluid circuits have fault counts within $RANGE_{NO_FAULT}$, then control determines that the fault is specific to $C_N$ in step 422 and control ends. Otherwise, control determines there is no fault specific to $C_N$ in step 424 and control ends.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A fault detection system for detecting a fault in a lifter oil manifold assembly (LOMA) of a displacement on a demand engine that is operable in activated and deactivated modes, comprising:

a first fluid circuit of said LOMA that selectively provides pressurized fluid to regulate operation of said engine between said activated and deactivated modes;

a sensor that is responsive to fluid pressure of said LOMA and that generates a pressure signal based thereon; and a control module that outputs a control signal to switch operation of said engine between said activated and deactivated modes and that determines a pressure differential based on a first pressure prior to switching between said modes and a second pressure after switching between said modes.

2. The fault detection system of claim 1 wherein said control module determines a PASS/FAIL status event of said first fluid circuit based on said pressure differential and a predetermined pressure differential range.

3. The fault detection system of claim 2 wherein said pressure differential range is defined by an upper pressure differential value and a lower pressure differential value.

4. The fault detection system of claim 3 wherein said control module indicates a FAIL status event of said first fluid circuit when said pressure differential is lower than said lower pressure differential value.

5. The fault detection system of claim 3 wherein said control module indicates a FAIL status event of said first fluid circuit when said pressure differential is greater than said upper pressure differential value.

6. The fault detection system of claim 1 wherein said first fluid circuit comprises:

a solenoid that selectively enables a flow of pressurized fluid to a lifter associated with a cylinder of said engine; and wherein said control module calculates said pressure differential based on a first pressure prior to said solenoid enabling said flow of pressurized fluid pressure and a second pressure subsequent to said solenoid enabling said flow of pressurized fluid.

7. The fault detection system of claim 1 wherein said control module detects a faulty fluid circuit when said number of FAIL status events exceeds a predetermined FAIL status range.

8. A method for detecting a fault in a plurality of fluid circuits of a lifter oil manifold assembly (LOMA) of a displacement on a demand engine that is operable in activated and deactivated modes, comprising:

monitoring fluid pressure of said LOMA;

generating a control signal to switch operation of said engine between said activated and deactivated modes;

determining a first pressure prior to switching between said modes;

determining a second pressure at a predetermined time subsequent to switching between said modes;

calculating a pressure differential based on said first pressure and said second pressure; and determining a PASS/FAIL status event of the fluid circuits based on said pressure differential and a predetermined pressure differential range.

9. The method of claim 8 wherein said pressure differential range is defined by an upper pressure differential value and a lower pressure differential value.

10. The method of claim 8 wherein a control module indicates a FAIL status event of said first fluid circuit when said pressure differential is lower than said lower pressure differential value.

11. The method of claim 8 wherein a control module indicates a FAIL status event of said first fluid circuit when said pressure differential is greater than said upper pressure differential value.

12. The method of claim 8 further comprising:

selectively enabling a flow of pressurized fluid to a lifter associated with a cylinder of said engine;

determining a first pressure prior to a solenoid enabling said flow of pressurized fluid;

determining a second pressure subsequent to said solenoid enabling said flow of pressurized fluid; and calculating said pressure differential based on said first and second pressures.

13. The method of claim 8 further comprising counting a number of FAIL status events and detecting a faulty fluid circuit when said number of FAIL status events exceeds a predetermined threshold value.

14. A method of detecting a fault in a specific fluid circuit of a lifter oil manifold assembly (LOMA) of a displacement on a demand engine, comprising:

monitoring a fluid pressure of said LOMA;

generating a fluid pressure signal;

generating a control signal to switch operation of said engine between an activated and a deactivated mode;

calculating a pressure differential based on said pressure signal and a predetermined time period over which said fluid pressure signal is generated;

indicating a PASS/FAIL status event of a plurality of fluid circuits based on said pressure differential and a predetermined pressure differential range; and counting a number of FAIL status events based on said PASS/FAIL status event.

15. The method of claim 14 further comprising generating a first and a second pressure signal based on said fluid pressure.

16. The method of claim 15 wherein said first pressure signal is based on said LOMA prior to deactivating said cylinder.

17. The method of claim 15 wherein said second pressure signal is based on said fluid pressure of said LOMA subsequent to deactivating said cylinder.

18. The method of claim 14 wherein said pressure differential range is defined by an upper pressure differential value and a lower pressure differential value.

19. The method of claim 14 further comprising:

determining whether said FAIL status events are within one of a first predetermined FAIL status range, a second predetermined FAIL status range or a third predetermined FAIL status range; and determining whether a fluid circuit is faulty based on said FAIL status events and one of said predetermined FAIL status ranges.

20. The method of claim 19 wherein said first predetermined FAIL status range is defined by an upper threshold value indicating a first number of FAIL events and a lower threshold value indicating a second number of FAIL events.

21. The method of claim 19 wherein said second predetermined FAIL status range is defined by an upper threshold value indicating a third number of FAIL events and a lower threshold value indicating a fourth number of FAIL events.

22. The method of claim 19 wherein said third predetermined FAIL status range is defined by an upper threshold value indicating a fifth number of FAIL events and a lower threshold value equal to zero.

* * * * *